US008844898B2

(12) United States Patent
Weir

(10) Patent No.: US 8,844,898 B2
(45) Date of Patent: Sep. 30, 2014

(54) BLOWOUT PREVENTER WITH RAM SOCKETING

(75) Inventor: James Weir, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 544 days.

(21) Appl. No.: 12/415,214

(22) Filed: Mar. 31, 2009

(65) Prior Publication Data

US 2010/0243926 A1 Sep. 30, 2010

(51) Int. Cl.
*E21B 33/06* (2006.01)

(52) U.S. Cl.
CPC ..... *E21B 33/062* (2013.01)
USPC ..... 251/1.3; 166/85.4

(58) Field of Classification Search
USPC ..... 251/1.1, 1.3; 166/85.4; 277/324, 325
See application file for complete search history.

(56) References Cited

U.S. PATENT DOCUMENTS

| | | | | |
|---|---|---|---|---|
| 2,178,698 | A | 11/1939 | Penick et al. | |
| 2,193,110 | A | 3/1940 | Penick et al. | 251/159 |
| 2,194,256 | A | 3/1940 | Allen | 251/59 |
| 2,231,613 | A | 2/1941 | Burke | |
| 2,304,793 | A | 12/1942 | Bodine, Jr. | |
| 2,592,197 | A | 4/1952 | Schweitzer | |
| 2,752,119 | A | 6/1956 | Allen et al. | |
| 3,001,803 | A | 9/1961 | Watts et al. | |
| 3,028,917 | A | 4/1962 | Rhodes | |
| 3,040,611 | A | 6/1962 | Tournaire | |
| 3,242,826 | A | 3/1966 | Smith | |
| 3,272,222 | A | 9/1966 | Allen et al. | |
| 3,399,728 | A | 9/1968 | Taylor | |
| 3,434,729 | A | 3/1969 | Shaffer et al. | 277/181 |
| 3,554,278 | A | 1/1971 | Reistle, III et al. | |
| 3,554,480 | A | 1/1971 | Rowe | |
| 3,561,526 | A | 2/1971 | Williams, Jr. et al. | 166/55 |
| 3,572,628 | A | 3/1971 | Jones | 251/1 |
| 3,647,174 | A | 3/1972 | LeRouax | |
| 3,670,761 | A | 6/1972 | LeRouax | |
| 3,716,068 | A | 2/1973 | Addison | |

(Continued)

FOREIGN PATENT DOCUMENTS

| | | |
|---|---|---|
| DE | 3516424 | 6/1986 |
| DE | 3317487 | 10/1993 |

(Continued)

OTHER PUBLICATIONS

Varco's NXT® Next Generation BOP Systems reduce the cost of drilling (6 pages) (2001).

(Continued)

*Primary Examiner* — John K Fristoe, Jr.
*Assistant Examiner* — Hailey K Do
(74) *Attorney, Agent, or Firm* — JL Salazar Law Firm

(57) ABSTRACT

A blowout preventer and seal structure for a blowout preventer, the seal structure having a the body with two front faces including a first face and a second face, a projection projecting out from the body, the first face on the projection, the second face in a plane, and the projection with the first face projecting out beyond the plane. This abstract is provided to comply with the rules requiring an abstract which will allow a searcher or other reader to quickly ascertain the subject matter of the technical disclosure and is submitted with the understanding that it will not be used to interpret or limit the scope or meaning of the claims, 37 C.F.R. 1.72(b).

16 Claims, 9 Drawing Sheets

(56) References Cited

U.S. PATENT DOCUMENTS 3,741,296 A 6/1973 Murman et al.
3,744,749 A 7/1973 LeRouax
3,766,979 A 10/1973 Petrick
3,771,601 A 11/1973 Garrett
3,791,616 A 2/1974 LeRouax
3,863,667 A 2/1975 Ward
3,871,613 A 3/1975 LeRouax
3,918,478 A 11/1975 LeRouax
3,922,780 A 12/1975 Green
3,941,141 A 3/1976 Robert
3,946,806 A 3/1976 Meynier, III
3,955,622 A 5/1976 Jones
4,007,797 A 2/1977 Jeter
4,007,905 A 2/1977 Mott
4,043,389 A 8/1977 Cobb
4,052,995 A 10/1977 Ellison
4,057,887 A 11/1977 Jones et al.
4,076,208 A 2/1978 Olson
4,119,115 A 10/1978 Carruthers
4,132,244 A 1/1979 Olson
4,132,265 A 1/1979 Williams, Jr.
4,132,266 A 1/1979 Randall
4,132,267 A 1/1979 Jones
4,140,041 A 2/1979 Frelau
4,162,057 A 7/1979 Qasim
4,188,860 A 2/1980 Miller
4,192,483 A 3/1980 Combes
4,215,749 A 8/1980 Dare et al.
4,220,206 A 9/1980 Van Winkle
4,229,012 A 10/1980 Williams, III ..... 277/127
4,253,638 A 3/1981 Troxell, Jr.
4,265,424 A 5/1981 Jones
4,290,577 A 9/1981 Olson
4,305,565 A 12/1981 Abbe
4,313,496 A 2/1982 Childs et al.
4,323,256 A 4/1982 Miyagishima et al. ..... 277/126
4,332,367 A 6/1982 Nelson ..... 251/1 A
4,341,264 A 7/1982 Cox et al.
4,347,898 A 9/1982 Jones
4,372,527 A 2/1983 Rosenhauch et al.
4,392,633 A 7/1983 Van Winkle
4,416,441 A 11/1983 Van Winkle
4,437,643 A 3/1984 Brakhage, Jr. et al. ..... 251/1 A
4,438,900 A 3/1984 Schaefer et al.
4,444,404 A * 4/1984 Parks, Jr. ..... 277/325
4,456,215 A 6/1984 Bishop et al. ..... 251/1 B
4,492,359 A 1/1985 Baugh
4,502,534 A 3/1985 Roche et al.
4,504,037 A 3/1985 Beam et al.
4,508,311 A 4/1985 Just et al.
4,508,313 A 4/1985 Jones ..... 251/1 A
4,516,598 A 5/1985 Stupak
4,518,144 A 5/1985 Vicic et al.
4,519,577 A 5/1985 Jones
4,523,639 A 6/1985 Howard, Jr.
4,526,339 A 7/1985 Miller
4,537,250 A 8/1985 Troxell, Jr.
4,540,045 A 9/1985 Molitor
4,540,046 A 9/1985 Granger et al.
4,550,895 A 11/1985 Shaffer
4,558,842 A 12/1985 Peil et al.
4,568,842 A 2/1986 Koike
4,582,293 A 4/1986 Jones
4,601,232 A 7/1986 Roxell, Jr.
4,612,983 A 9/1986 Karr, Jr.
4,646,825 A 3/1987 Van Winkle
4,647,002 A 3/1987 Crutchfield
4,655,284 A 4/1987 McIlvride
4,690,033 A 9/1987 Van Winkle
4,690,411 A 9/1987 Van Winkle
4,699,350 A 10/1987 Herve
4,770,387 A 9/1988 Granger ..... 251/1.3
4,840,346 A 6/1989 Adhyana et al.
4,877,217 A 10/1989 Peil et al.
4,911,410 A 3/1990 Baker
4,922,423 A 5/1990 Korney et al.
4,923,005 A 5/1990 Laky et al.
4,923,006 A 5/1990 Hartmann et al.
4,923,008 A 5/1990 Wachowicz et al.
4,938,290 A 7/1990 Legget et al.
4,943,031 A 7/1990 Van Winkle
4,969,390 A 11/1990 Williams, III
4,969,627 A 11/1990 Williams, III
4,997,162 A 3/1991 Baker et al.
5,002,130 A 3/1991 Laky
5,011,110 A 4/1991 Le ..... 251/1.1
5,013,005 A 5/1991 Nance ..... 251/1.3
5,025,708 A 6/1991 Smith et al.
5,056,418 A 10/1991 Granger et al.
5,063,828 A 11/1991 Kamimura
5,064,164 A * 11/1991 Le ..... 251/1.1
5,125,620 A * 6/1992 Young ..... 251/1.3
5,150,049 A 9/1992 Schuetz
5,178,215 A 1/1993 Yenulis et al.
5,199,493 A 4/1993 Sodder, Jr.
5,199,683 A 4/1993 Le
5,217,073 A 6/1993 Bruns
5,237,899 A 8/1993 Schartinger
5,255,890 A 10/1993 Morrill
5,320,325 A 6/1994 Young et al.
5,360,061 A 11/1994 Womble
5,361,832 A 11/1994 Van Winkle
5,400,857 A 3/1995 Whitby et al.
5,407,172 A 4/1995 Young et al.
5,501,424 A 3/1996 Williams et al.
5,505,426 A 4/1996 Whitby et al.
5,515,916 A 5/1996 Haley ..... 166/55
5,566,753 A 10/1996 Van Winkle et al.
5,575,452 A 11/1996 Whitby et al.
5,588,491 A 12/1996 Brugman et al.
5,590,867 A 1/1997 Van Winkle
5,653,418 A 8/1997 Olson
5,655,745 A 8/1997 Morrill
5,662,171 A 9/1997 Brugman et al. ..... 166/383
5,713,581 A 2/1998 Carlson et al. ..... 277/188 R
5,735,502 A 4/1998 Levett et al.
5,775,420 A 7/1998 Mitchell et al.
5,778,918 A 7/1998 McLelland
5,833,208 A * 11/1998 Lee, Jr. ..... 251/1.3
5,863,022 A 1/1999 Van Winkle
5,897,074 A 4/1999 Marino
5,897,094 A 4/1999 Brugman et al. ..... 251/1.3
5,918,851 A 7/1999 Whitby
5,944,110 A * 8/1999 Watts et al. ..... 166/320
5,961,094 A 10/1999 Van Winkle
5,975,484 A 11/1999 Brugman et al.
6,006,647 A 12/1999 Van Winkle
6,012,528 A 1/2000 Van Winkle
6,016,880 A 1/2000 Hall et al.
D425,525 S 5/2000 Wooten
6,089,526 A 7/2000 Olson ..... 251/1.3
6,113,061 A 9/2000 Van Winkle
6,158,505 A 12/2000 Araujo ..... 166/55
6,164,619 A 12/2000 Van Winkle et al.
6,173,770 B1 1/2001 Morrill
6,192,680 B1 2/2001 Brugman et al.
6,244,336 B1 6/2001 Kachich
6,244,560 B1 6/2001 Johnson
6,276,450 B1 8/2001 Seneviratne
6,296,225 B1 10/2001 Watts
6,367,804 B1 * 4/2002 Watts ..... 277/325
6,374,925 B1 4/2002 Elkins et al.
6,454,015 B1 9/2002 Armstrong et al.
6,484,808 B2 11/2002 Jones et al.
6,509,733 B2 1/2003 Blubaugh et al.
6,510,895 B1 1/2003 Koleilat et al.
6,510,897 B2 1/2003 Hemphill
6,530,432 B2 3/2003 Gipson
6,554,247 B2 4/2003 Berckenhoff et al.
6,601,650 B2 8/2003 Sundararajan
6,718,860 B2 4/2004 Mitsukawa et al.
6,719,042 B2 4/2004 Johnson et al.
6,742,597 B2 6/2004 Van Winkle et al.
6,782,799 B2 8/2004 Vincent

(56) References Cited

U.S. PATENT DOCUMENTS

| | | | | |
|---|---|---|---|---|
| 6,834,721 | B2 | 12/2004 | Suro | |
| 6,843,463 | B1 | 1/2005 | McWhorter et al. | |
| 6,845,959 | B2 | 1/2005 | Berckenhoff et al. | |
| 6,857,634 | B2 | 2/2005 | Araujo | |
| 6,877,712 | B2 | 4/2005 | Wiedemann | |
| 6,955,357 | B2 | 10/2005 | Griffin et al. | |
| 6,964,303 | B2 | 11/2005 | Mazorow et al. | |
| 6,969,042 | B2 | 11/2005 | Gaydos | 251/1.3 |
| 6,974,135 | B2 | 12/2005 | Melancon et al. | |
| 7,004,444 | B2 | 2/2006 | Kinder | |
| 7,011,159 | B2 | 3/2006 | Holland | |
| 7,011,160 | B2 | 3/2006 | Boyd | |
| 7,023,199 | B2 | 4/2006 | Blubaugh et al. | |
| 7,036,613 | B2 | 5/2006 | Burr | |
| 7,044,430 | B2 | 5/2006 | Brugman et al. | |
| 7,051,989 | B2 | 5/2006 | Springett et al. | 251/1.1 |
| 7,051,990 | B2 | 5/2006 | Springett et al. | 251/1.1 |
| 7,055,594 | B1 | 6/2006 | Springett et al. | |
| 7,086,467 | B2 | 8/2006 | Schlegelmilch et al. | |
| 7,100,892 | B2 | 9/2006 | Iwabuchi | |
| 7,108,081 | B2 | 9/2006 | Boyadjieff | |
| 7,121,185 | B2 | 10/2006 | Alefai | |
| 7,125,055 | B2 | 10/2006 | Dallas | |
| 7,159,652 | B2 | 1/2007 | McGuire et al. | |
| 7,165,619 | B2 | 1/2007 | Fox et al. | |
| 7,181,808 | B1 | 2/2007 | Van Winkle | |
| 7,195,224 | B2 | 3/2007 | Le | 251/1.3 |
| 7,207,382 | B2 | 4/2007 | Schaeper | |
| 7,216,872 | B1 | 5/2007 | Shaw et al. | |
| 7,225,793 | B2 | 6/2007 | Schwulst et al. | |
| 7,225,873 | B2 | 6/2007 | Schlegelmilch et al. | |
| 7,234,530 | B2 | 6/2007 | Gass | |
| 7,243,713 | B2 | 7/2007 | Isaacks et al. | 166/85.4 |
| 7,246,666 | B2 | 7/2007 | Hemphill et al. | |
| 7,270,190 | B2 | 9/2007 | McWhorter et al. | |
| 7,274,989 | B2 | 9/2007 | Hopper | |
| 7,287,544 | B2 | 10/2007 | Seneviratne et al. | |
| 7,331,562 | B2 | 2/2008 | Springett | 251/1.3 |
| 7,350,587 | B2 | 4/2008 | Springett et al. | |
| 7,354,026 | B2 | 4/2008 | Urrutia | |
| 7,360,603 | B2 | 4/2008 | Springett et al. | |
| 7,367,396 | B2 | 5/2008 | Springett et al. | |
| 7,389,817 | B2 | 6/2008 | Almdahl et al. | |
| 7,410,003 | B2 | 8/2008 | Ravensbergen et al. | |
| 7,434,369 | B2 | 10/2008 | Uneyama et al. | |
| 7,464,751 | B1 | 12/2008 | Abel | 166/85.4 |
| 7,464,765 | B2 | 12/2008 | Isaacks et al. | 166/378 |
| 7,487,848 | B2 | 2/2009 | Wells et al. | |
| 7,510,002 | B2 | 3/2009 | Brown et al. | |
| 7,520,129 | B2 | 4/2009 | Springett | |
| 7,523,644 | B2 | 4/2009 | Van Winkle | |
| 7,673,674 | B2 | 3/2010 | Lam | |
| 7,703,739 | B2 | 4/2010 | Judge et al. | |
| 7,721,808 | B2 | 5/2010 | Dallas et al. | |
| 7,726,418 | B2 | 6/2010 | Ayling | |
| 7,748,473 | B2 | 7/2010 | Wells et al. | |
| 7,798,466 | B2 | 9/2010 | Springett et al. | |
| 7,814,979 | B2 | 10/2010 | Springett et al. | |
| 7,832,706 | B2 | 11/2010 | Judge | |
| 7,926,501 | B2 | 4/2011 | Springett et al. | |
| 7,967,299 | B2 | 6/2011 | McClanahan | |
| 8,033,338 | B2 | 10/2011 | Springett | |
| 8,066,070 | B2 | 11/2011 | Springett | |
| 2004/0021269 | A1 | 2/2004 | Gaudette | |
| 2004/0124380 | A1 | 7/2004 | Van Winkle | |
| 2005/0242519 | A1 | 11/2005 | Koleilat | |
| 2006/0076526 | A1 | 4/2006 | McWhorter et al. | |
| 2006/0144586 | A1 | 7/2006 | Urrutia | |
| 2006/0278406 | A1 | 12/2006 | Judge et al. | |
| 2007/0075288 | A1 | 4/2007 | Matte | |
| 2007/0137688 | A1 | 6/2007 | Yoshida | |
| 2007/0236006 | A1 | 10/2007 | Fultz | |
| 2008/0040070 | A1 | 2/2008 | McClanahan | |
| 2008/0076526 | A1 | 3/2008 | Zhang | |
| 2008/0135791 | A1 | 6/2008 | Juda | |
| 2008/0189954 | A1 | 8/2008 | Lin | |
| 2008/0196888 | A1 | 8/2008 | Judge et al. | |
| 2008/0267786 | A1 | 10/2008 | Springett et al. | |
| 2009/0056132 | A1 | 3/2009 | Foote | |
| 2010/0038088 | A1 | 2/2010 | Springett | |
| 2010/0243926 | A1 | 9/2010 | Weir | |
| 2010/0319906 | A1 | 12/2010 | Van Winkle | |
| 2012/0012340 | A1 | 1/2012 | Ensley et al. | |
| 2012/0241663 | A1 | 9/2012 | Wood | |

FOREIGN PATENT DOCUMENTS

| | | |
|---|---|---|
| GB | 1352258 | 9/1971 |
| GB | 1352260 | 9/1971 |
| GB | 2154265 | 3/1985 |

OTHER PUBLICATIONS

The Cameron Variable Bore Ram, Cameron Oil Tools (9 pages) (1978).

Ram-Type Blowout Preventers Rams, NL Shaffer, pp. 32-33 (Jan. 1979).

UltraLock II Automatic Locking System, Shaffer® A Varco Company (2 pages) (2002).

PCT/US2010/027760 International Search Report (May 27, 2010).

National Oilwell Varco. Shaffer 7"—5,000 PSI LXT RAM BOP Datasheet [online], [retrieved on Jan. 10, 2012]. Retrieved from the Internet: <URL: http://apps.nov.com/GetDocument/getDocument.aspx?doc=VauwU3oEmIRR5tXu4pHU9ZMorUn8t2fOkk/epJTd2wnzTwxUs9rJPGQhaetY9s5p0pUJ7Mjkr4e0TprFOSNmF9cRCTK ggbZab8rkFiiVJxrGzB5CkviJajOOYKt8UeNI >.

National Oilwell Varco. Shaffer 9"—3,000 PSI LXT RAM BOP Datasheet [online], [retrieved on Jan. 10, 2012]. Retrieved from the Internet: <URL: http://apps.nov.com/GetDocument/getDocument.aspx?doc=4mY2KOczvSp7xgbC/yAUNOIj8Xip0PFoCBfMqXeGZv8yoA+gy0YSN67XJhL9yJC7Jxv0KFBqycdmv+ceINv8DKr9O1KrswSLTodwdeUHOjfSYNNAb8w4/Q3y6GJsnuyAdWmpT+6mzpjzD1T5hCdNCxLvXPFLH2z0Jp41vjuaVZw=>.

National Oilwell Varco. Shaffer 11"—5,000 PSI LXT RAM BOP Datasheet [online], [retrieved on Jan. 10, 2012]. Retrieved from the Internet: <URL: http://apps.nov.com/GetDocument/getDocument.aspx?doc=4mY2KOczvSp7xgbC/yAUNHH4NngVNvgjSTgsbDKUG2SvCR7H5ZESdyAEqrxcgW/o6rqufYWXU6DWKF7jlGbLunTH4s52FHRihfqSujUiMirakeTXNCByEVNU0oIPTHu8FOg3BT3zRZSDOEdgl76cV9g==>.

National Oilwell Varco. Shaffer 13 5/8"—10,000 PSI LXT RAM BOP Datasheet [online], [retrieved on Jan. 10, 2012]. Retrieved from the Internet: <URL: http://apps.nov.com/GetDocument/getDocument.aspx?doc=4mY2KOczvSp7xgbC/yAUNEwbgkvE1ayIKwH+U89zJRfdujD68A7tvPw4eyAA3Iz4dH2ZExbPe0QnqqPI5q3SS33II6fKz+jwj9AVe2+jHPmG+9ahyvcejLFqDBkZfKmtrkaeiTCdGx+7e1+EE3ukehmBileYewHbwgkhaYTbBOk=>.

National Oilwell Varco. LWS Shaffer Ram Blowout Preventer [online], [retrieved on Jan. 10, 2012]. Retrieved from the Internet: <URL: http://www.nov.com/Drilling/Drilling_Pressure_Control/Blowout_Preventers/Ram_BOPs/LWS_Shaffer_Ram_Blowout_Preventer.aspx>.

National Oilwell Varco. NXT—Ram Blowout Preventer [online], [retrieved on Jan. 10, 2012]. Retrieved from the Internet: <URL: http://www.nov.com/Drilling/Drilling_Pressure_Control/Blowout_Preventers/Ram_BOPs/NXT-RAM_Blowout_Preventer.aspx>.

National Oilwell Varco. Ram Blowout Preventers [online], [retrieved on Jan. 10, 2012]. Retrieved from the Internet: <URL: http://www.nov.com/Drilling/Drilling_Pressure_Control/Blowout_Preventers/Ram_BOPs.aspx>.

National Oilwell Varco. Shaffer—SLX Ram Blowout Preventer [online], [retrieved on Jan. 10, 2012]. Retrieved from the Internet: <URL: http://www.nov.com/Drilling/Drilling_Pressure_Control/Blowout_Preventers/Ram_BOPs/Shaffer-SLX_Ram_Blowout_Preventer.aspx>.

(56) References Cited

OTHER PUBLICATIONS

English translation of Abstract for German Patent Application No. 3516424, retrieved from the internet on Feb. 1, 2012, [website address: http://depatisnet.dpma.de/DepatisNet/depatisnet?window=1&space=main&content=treffer&action=textpdf&docid=DE00003516424A1], 3 pages.
English translation of Abstract for German Patent Application No. 3317487, retrieved from the internet on Feb. 3, 2012, [website address: http://depatisnet.dpma.de/DepatisNet/depatisnet?window=1&space=main&content=treffer&action=textpdf&docid=DE00003317487A1], 3 pages.
International Preliminary Report on Patentability dated Oct. 20, 2011 from counterpart PCT Application No. PCT/US/2010/027760.
Written Opinion dated May 27, 2010 from counterpart PCT Application No. PCT/US/2010/027760.
Office Action for counterpart Canadian Patent Application No. 2,752,537 dated Nov. 28, 2012, 2 pages.
Response to Office Action for Canadian counterpart Patent Application No. 2,752,537 dated May 28, 2013, 18 pages.
Office Action for United Kingdom counterpart Patent Application No. GB1115882.1 dated Mar. 26, 2013, 2 pages.
Jul. 23, 2013 Response to Examination Report dated Mar. 26, 2013 in counterpart UK Patent Application No. 11 15882.1, 35 pages.

* cited by examiner

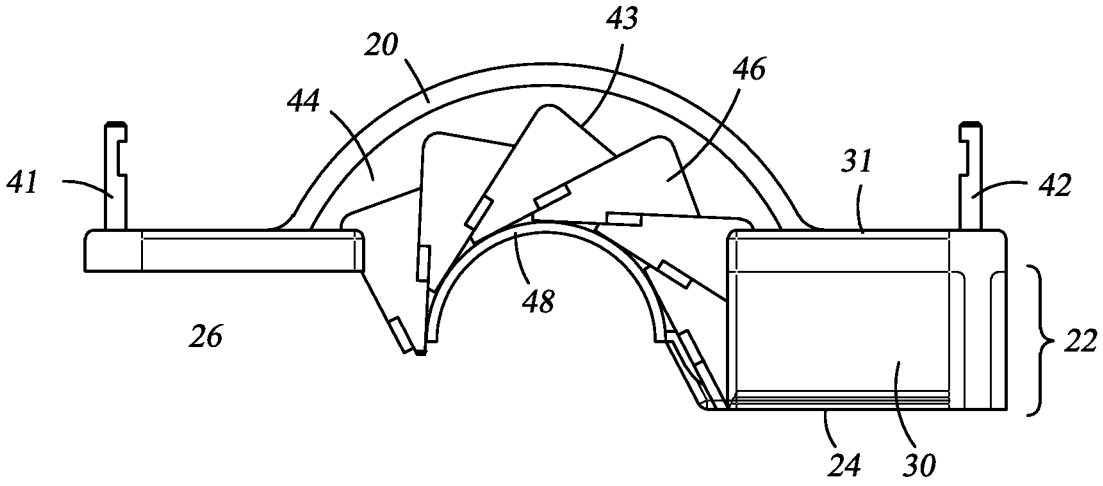
Fig. 4C
Fig. 4D
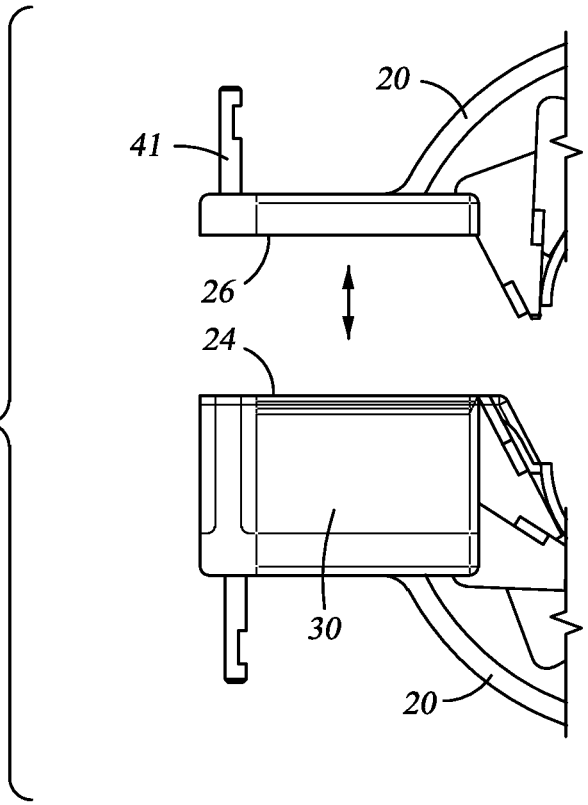

BLOWOUT PREVENTER WITH RAM SOCKETING

BACKGROUND OF THE INVENTION

1. Field of the Invention

This present invention is directed to blowout preventers; to blowout preventers with opposed rams; to blowout preventers with seal structure on one ram which is received and held in corresponding space in an opposing ram; and methods of their use.

2. Description of Related Art

There is a wide variety of known blowout preventers, blowout preventer rams and seals, and methods for closing rams on a pipe.

Typical blowout preventers have selectively actuatable rams. Many such rams have a ram body with a top seal and a packer or seal holder that holds a face seal. With the rams closed on a pipe, the face seals on opposing rams contact and seal against each other. Such seals can be subject to high pressures and to chemical reaction with drilling fluids which can damage the seals. Pressure applied to a blowout preventer—either in a test or in an actual blowout situation—can cause the rams to move and wobble, which in turn causes the face seals to move with respect to each other which can result in damage to the face seals.

FIG. 1 shows parts of a prior art blowout preventer which includes two ram bodies or "blocks" (one, on the left, shown in an exploded view) each with a top seal and a face seal. Each face seal is held in a seal holder (or holders).

As shown in FIGS. 2A and 2B in a prior art blowout preventer BP, plates P of a first seal holder structure of a first ram R abut plates L of a second seal holder structure of a second ram M. Also, face seal F of the first ram R abuts a face seal C of the second ram M. Face seal portions of a single face seal are in a single plane. Similar contacts occur with the face seals and seal holders of FIG. 1.

Pressure on the blowout preventer BP, indicated by the arrows P, causes the plates on both sides 5*a* and 5*b* of the blowout preventer BP to move against each other and causes the face seals to move against each other. This movement can result in damage to the face seals. Face seal portions on both sides of a pipe (on both sides 5*a*, 5*b*) can move against and damage each other.

Prior patents disclose a variety of blowout preventers, and seals for them, including, but not limited to, U.S. Pat. Nos. 2,194,256; 2,752,119; 3,946,806; 4,043,389; 4,313,496; 4,132,267; 4,437,643; 4,456,215; 4,558,842; 4,969,390; 4,492,359; 4,550,895; 4,504,037; 3,272,222; 3,744,749; 4,253,638; 4,332,367; 4,523,639; 5,011,110; 5,025,708; 5,056,418; 5,064,164; 5,400,857; 5,515,916; 5,575,452; 5,655,745; 5,918,851; 7,207,382; 7,243,713; and 7,464,765 (all said patents incorporated fully herein for all purposes.

There has long been a need, recognized by the present inventor, for a blowout preventer in which the damaging effects of pressure applied to rams and face seals are reduced or eliminated. There has long been a need, recognized by the present inventor, for a blowout preventer which effectively and efficiently deals with pressure imposed on the blowout preventer, both in testing and in an actual blowout situation, in which unwanted movement of the rams closed on a pipe, and of their face seals, is inhibited or reduced.

SUMMARY OF THE PRESENT INVENTION

In one aspect, the present invention discloses a blowout preventer with opposing ram face seals that are a part of seal structure that includes extrusion plates. The extrusion plates are sized and configured so that, with the rams of the blowout preventer closed on a pipe, projecting portions of the extrusion plates on one ram project or are "socketed" into corresponding spaces within the opposing ram.

In methods according to the present invention for inhibiting the movement of closed rams with respect to each other due to pressure applied to the rams, part of one ram are received and held in ("socketed within") an opposing ram.

The present invention discloses, in certain aspects, a ram for a blowout preventer, the ram including: a ram body with a front surface; seal structure on the ram body having two front faces including a first face and a second face and a projection; the first face on the projection; and the projection with the first face projecting out beyond a plane in which the second face is located. Such a ram may have a recessed portion formed by the seal structure for receiving part of a projection of an opposing ram; the recessed portion defined in part by the second face; and the second face positioned for sealing contact with a face of the projection of an opposing ram.

The present invention discloses, in certain aspects, a seal structure for a ram of a blowout preventer, the seal structure including: a body having two front faces including a first face and a second face; a projection projecting out from the body; the first face on the projection; the second face in a plane; and the projection with the first face projecting out beyond the plane. Such a seal structure may have a recessed portion in the body for receiving part of a projection of an opposing ram; the recessed portion defined in part by the second face; and the second face positioned for sealing contact with a face of a projection of an opposing ram.

The present invention discloses, in certain aspects, a blowout preventer with two opposing rams, each ram including: a ram body, each ram body having a front surface; seal structure on each ram body; each seal structure having two front faces including a first face and a second face; the seal structure having a projection projecting out therefrom; the first face on the projection; and the projection with the first face projecting out beyond the plane in which the second face is located. Such a blowout preventer may have a recessed portion formed by each seal structure for receiving part of a projection of an opposing ram, each recessed portion defined in part by a second face of a seal structure, each second face positioned for sealing contact with a face of a projection of an opposing ram, a recess in each ram body, each recessed portion formed by a seal structure disposed in a recess of the ram body, each recess in a ram body located for receiving part of a projecting portion of an opposing ram and for supporting said part therein, and each recess sized for sealing contact with part of a projecting portion of an opposing ram.

Accordingly, the present invention includes features and advantages which are believed to enable it to advance blowout preventer technology. Characteristics and advantages of the present invention described above and additional features and benefits will be readily apparent to those skilled in the art upon consideration of the following description of detailed preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions of embodiments preferred at the time of filing for this patent that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain embodiments of the invention, other objects and purposes will be readily apparent to one of skill in this art who has the benefit of this invention's teachings and disclosures. It is, therefore, an object of at least certain embodiments of the present invention to provide the embodiments and aspects listed above and: new, useful, unique, efficient, nonobvious blowout preventers and methods of their use; and such blowout preventers which have opposed rams with socketing structures and corresponding recesses.

It is, therefore, an object of at least certain embodiments of the present invention to provide: new, useful, unique, efficient, nonobvious rams for blowout preventers and new, useful, unique, efficient, nonobvious seal structures for rams for blowout preventers; and methods of their use.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly, from a cursory inspection or review, the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

Certain aspects, certain embodiments, and certain preferable features of the invention are set out herein. Any combination of aspects or features shown in any aspect or embodiment can be used except where such aspects or features are mutually exclusive.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate embodiments preferred at the time of filing for this patent and are not to be used to improperly limit the scope of the invention which may have other equally effective or legally equivalent embodiments.

FIG. 4C is a top view of the face seal of FIG. 4A.

FIG. 4D is a partial view of parts of two face seals as in FIG. 4C.

Figure 1:
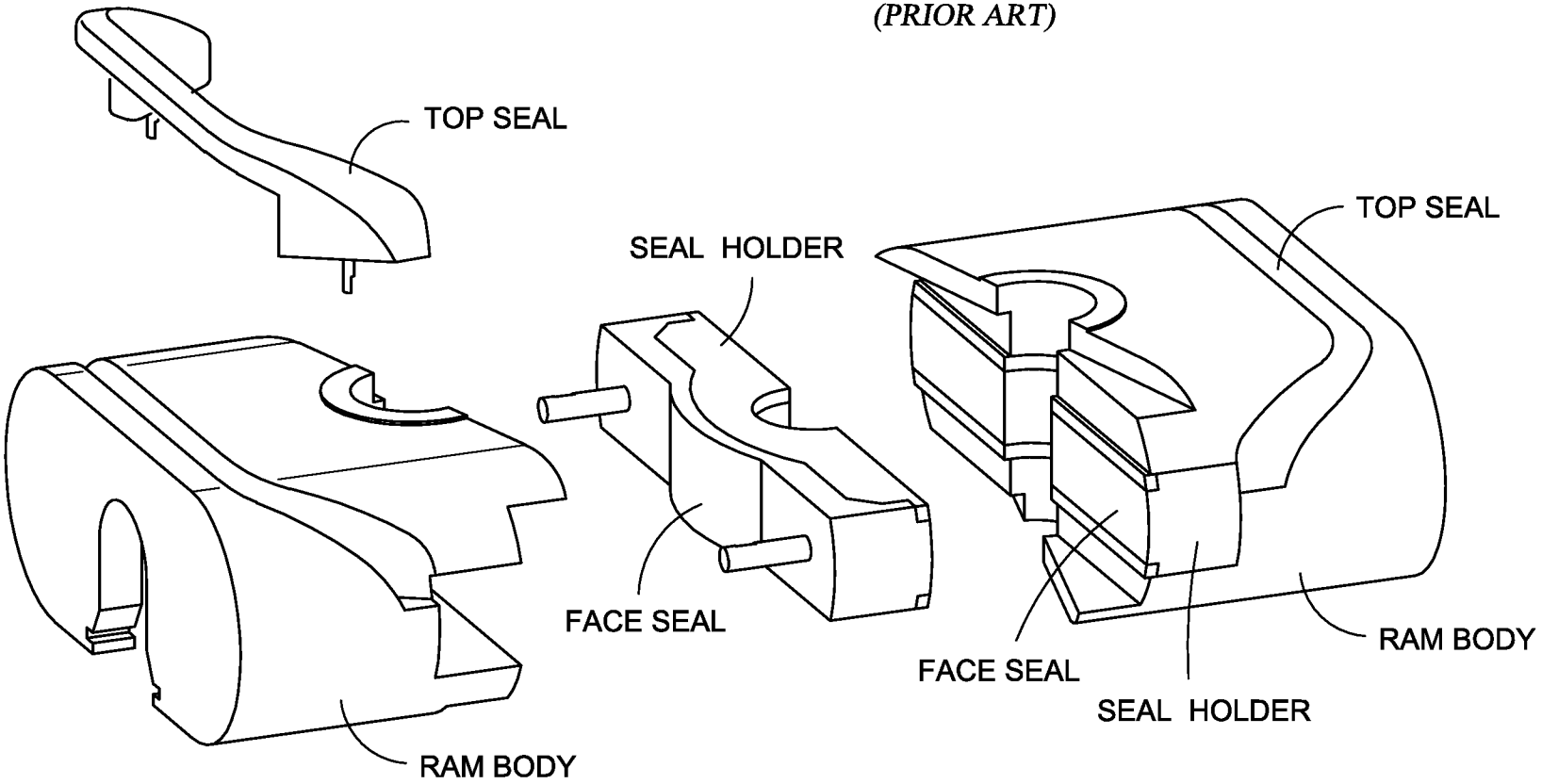
Fig. 1 (PRIOR ART)
FIG. 1 is a perspective exploded view of parts of a prior art blowout preventer.
Figure 2A:
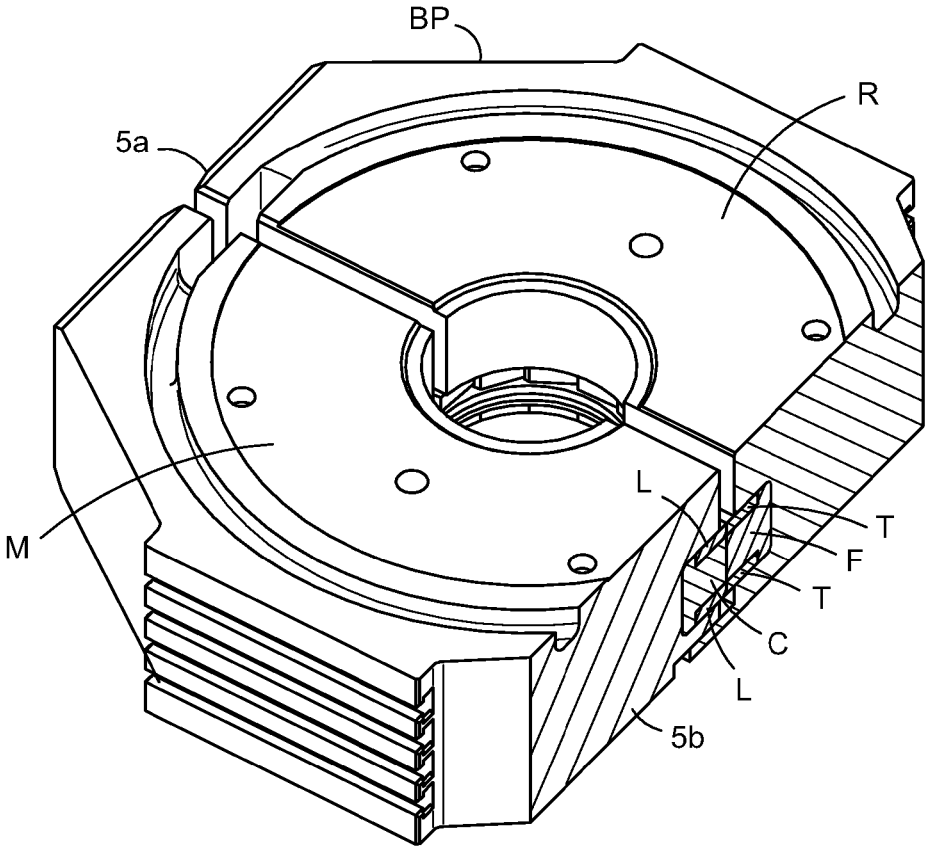
Fig. 2A (PRIOR ART)
FIG. 2A is a partial perspective view of the blowout preventer of FIG. 1, partially cutaway.
Figure 2B:
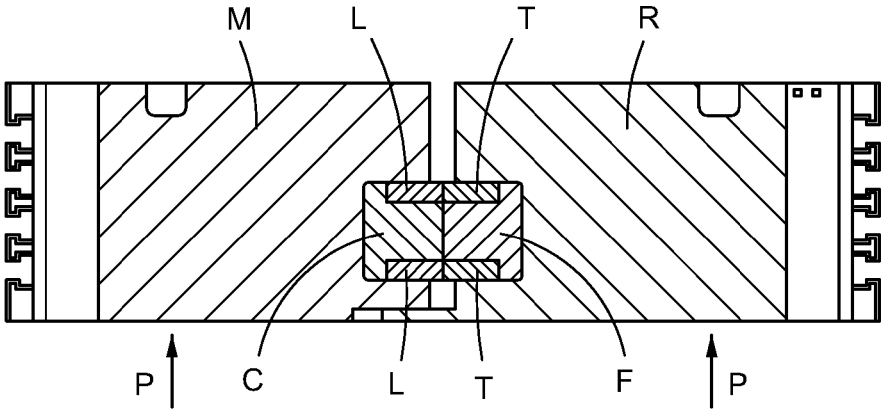
Fig. 2B (PRIOR ART)
FIG. 2B is a cross-section view of the blowout preventer of FIG. 2A.

Certain embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of certain embodiments and are not intended to limit the invention or the appended claims. On the contrary, the intention is to cover all modifications, equivalents and alternatives falling within the spirit and scope of the invention as defined by the appended claims. In showing and describing these embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiments, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

What follows are the descriptions of embodiments preferred at the time of filing for this patent.

FIGS. 3A-3D show a blowout preventer 10 according to the present invention which has two opposed movable rams each with a ram block 12. Each ram block 12 has a top seal 16 (see FIG. 3D) in a recess 17 in a ram block 18.

Figure 3A:
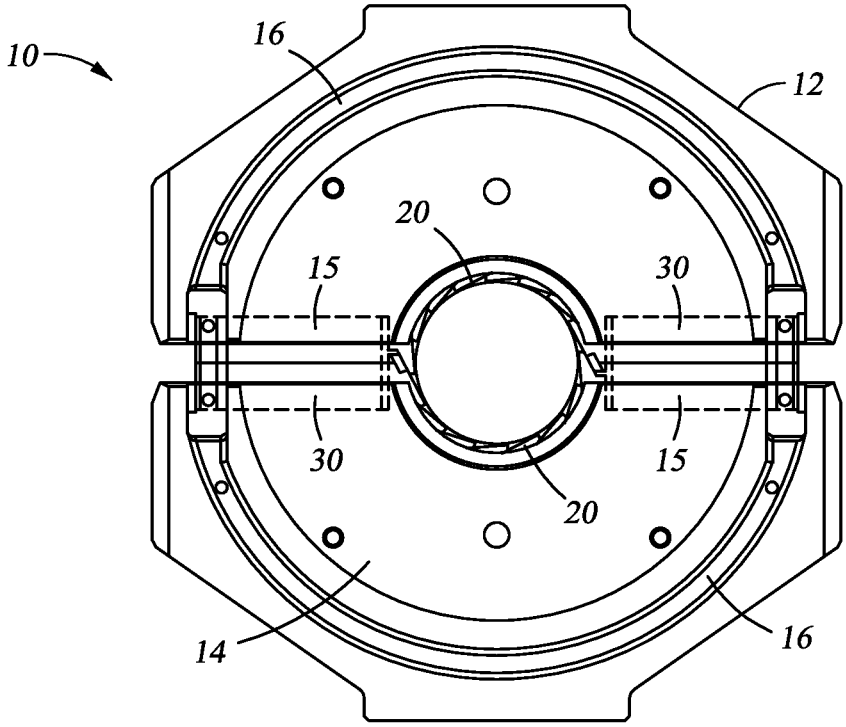
FIG. 3A is a top view of a blowout preventer according to the present invention.
Figure 3B:
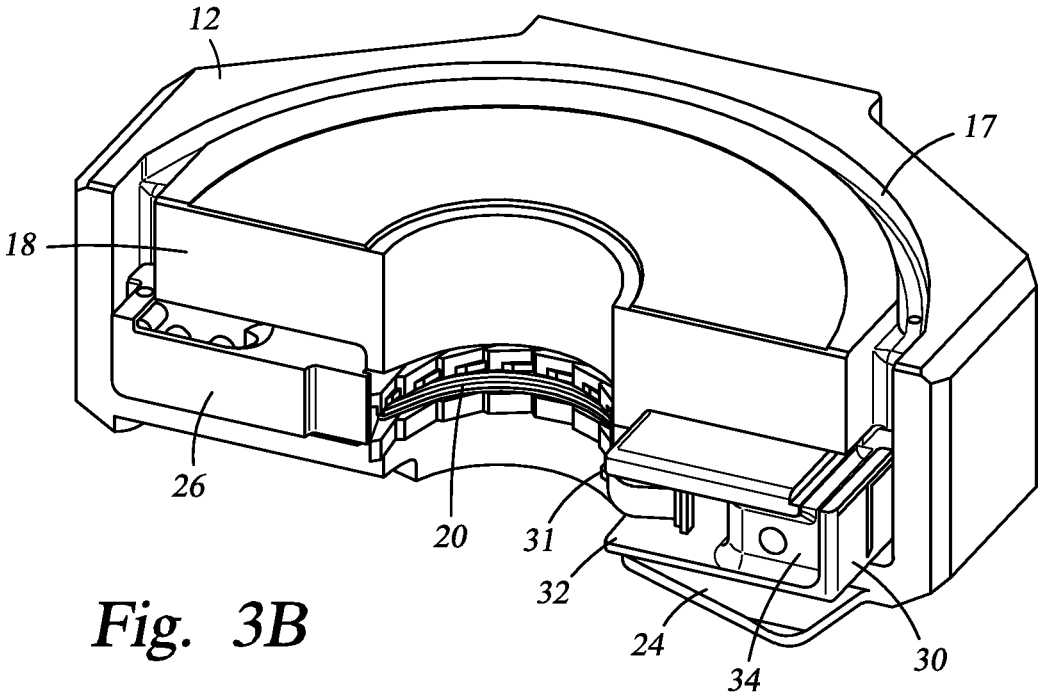
FIG. 3B is a perspective view of part of the blowout preventer of FIG. 3A.
Figure 3C:
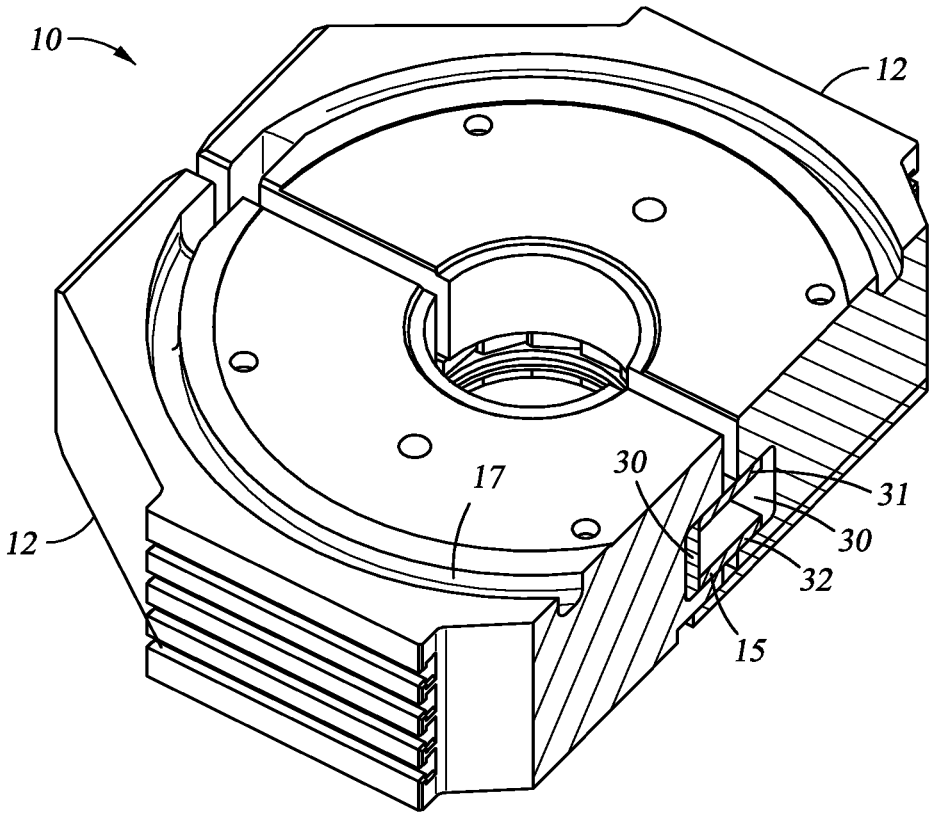
FIG. 3C is a perspective view, partially cutaway, of the blowout preventer of FIG. 3A.
Figure 3D:
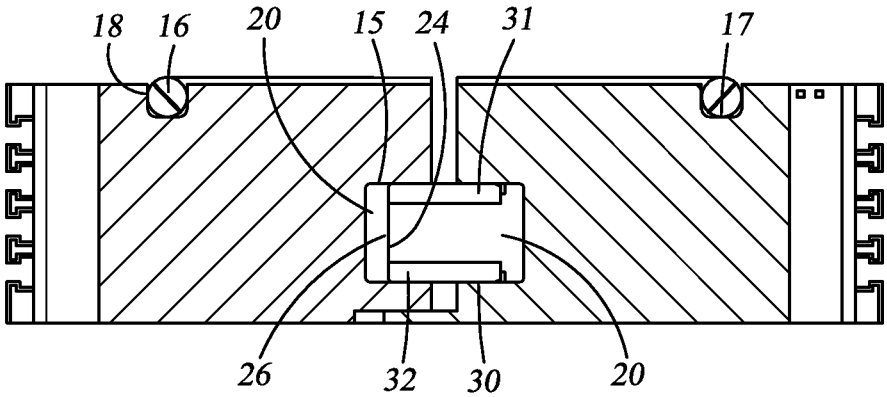
FIG. 3D is a cross-section view of the blowout preventer of FIG. 3C.

Each ram block 12 has a face seal 20 with an extrusion plate structure 30 adjacent a projecting portion 22 of the face seal 20. Each ram block has a recess 15 which receives part of an opposing structure 30, as shown in FIG. 3C which is partially cutaway to reveal this reception of part of the structure 30 in a recess 15, and as shown in FIG. 3D. Thus a face 24 of each face seal 20 sealingly contacts an opposing face 26 of an opposing face seal 20 and this contact occurs within a recess 15.

Each extrusion plate structure 30 includes a top plate 31 and a bottom plate 32 spaced-apart by a base 34, as shown, e.g., in FIGS. 3C and 3D parts of the plates 31, 32 have a tight fit with engineered tolerance in the recesses 15.

Figure 3E:
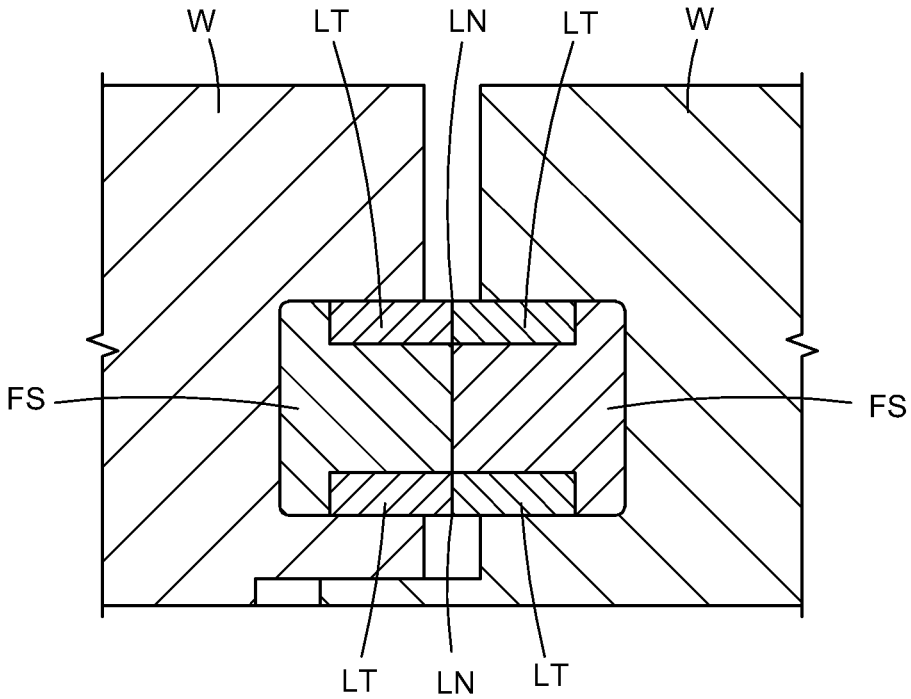
Fig. 3E (PRIOR ART)
FIG. 3E is a cross-section view of a prior art blowout preventer of FIG. 3C.

FIG. 3E illustrates the contact of face seals FS in rams W of a prior art blowout preventer. Even with plates LT in place, extrusion occurs (with seal deformation under pressure) between the plates LT (e.g. along a line LN).

Figure 3F:
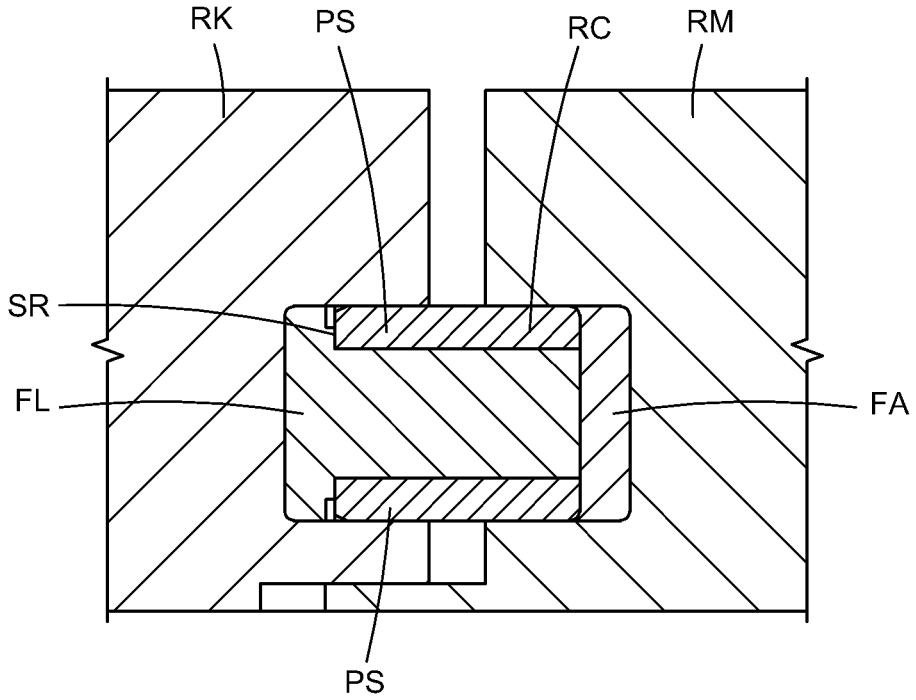
FIG. 3F is a cross-section view of the blowout preventer of FIG. 3C.

FIG. 3F shows the socketing of the plates PS of a structure SR according to the present invention of a ram block RK projecting into and within a recess RC of a ram block RM according to the present invention. A face seal FL sealingly contacts a corresponding face seal FA within the recess RC. In such a design, there are no exposed or unsupported seal junctures.

Figure 4A:
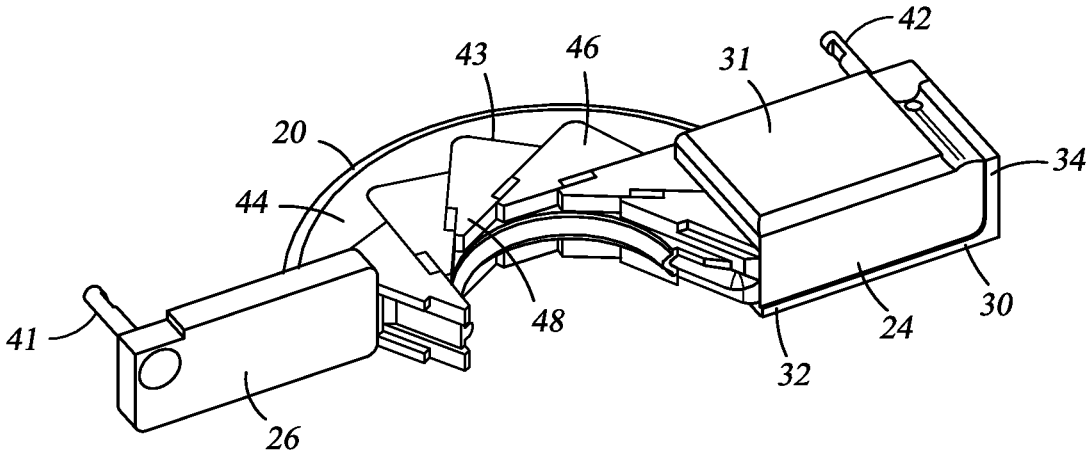
FIG. 4A is a front perspective view of a face seal according to the present invention of the blowout preventer of FIG. 3A.
Figure 4B:
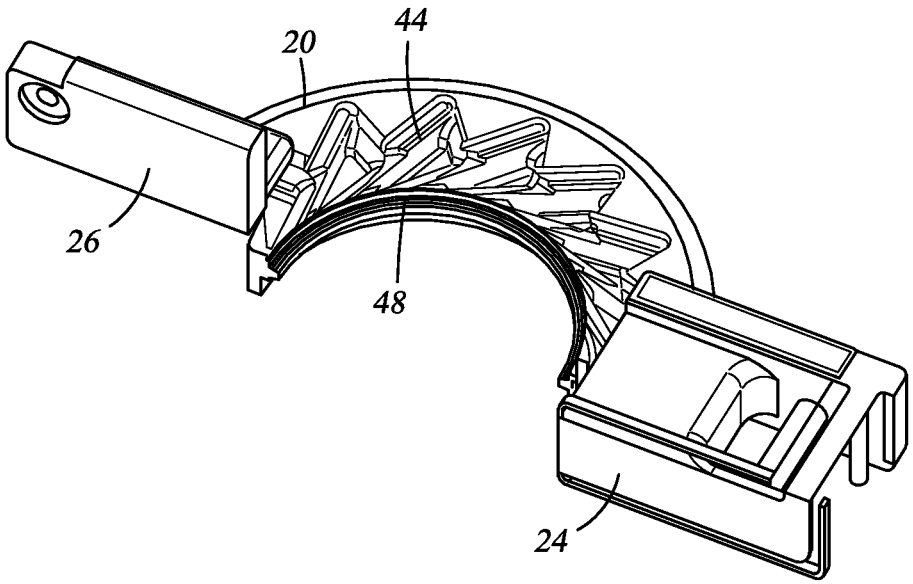
FIG. 4B is a rear perspective view of the face seal of FIG. 4A.

As shown in FIGS. 4A-4C, the face seals 20 are, in one aspect, a single molded or machined piece of material such as nitrile rubber, elastomer, other molded material, or suitable plastic. Rear shafts 41, 42 are secured within a ram block to hold the face seal in place. A body 44 has recesses 43 for metal inserts 46 (see FIG. 4C). A portion 48 of the face seal 20 forms a pipe bore for a pipe (not shown).

FIG. 4D illustrates how a structure 30 of one face seal 20 moves adjacent a face 26 of an opposing face seal 20.

Figure 5A:
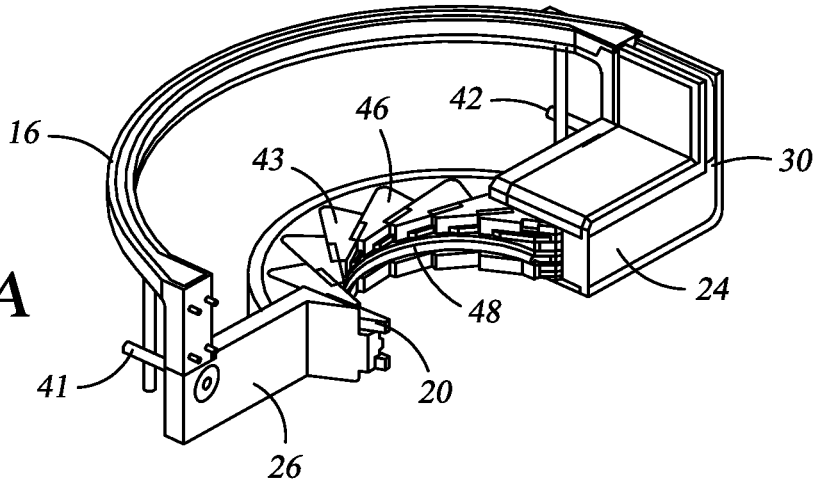
FIG. 5A is a front perspective view of a face-seal/top-seal combination according to the present invention of the blowout preventer of FIG. 3A.
Figure 5B:
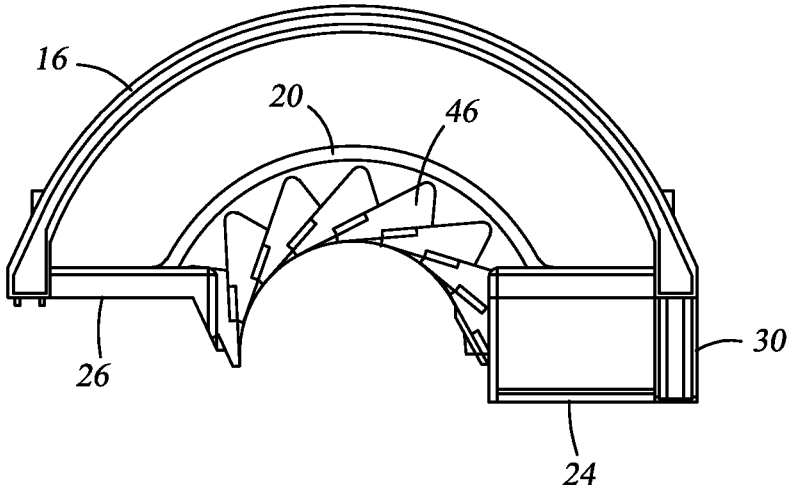
FIG. 5B is a top view of the combination of FIG. 5A.
Figure 5C:
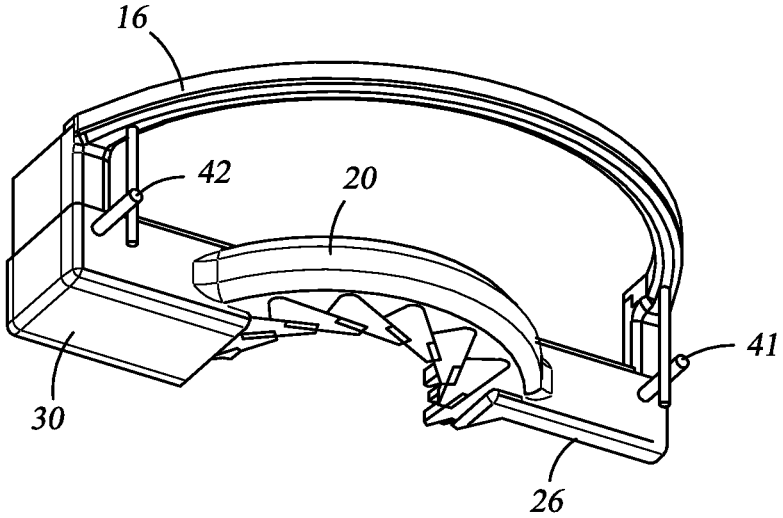
FIG. 5C is a rear perspective view of the combination of FIG. 5A.

FIGS. 5A-5C show the combination of a face seal 20, a top seal 16, and an extrusion plate structure 30. This 3-part combination can be connected together prior to installation (e.g. with a bonding agent and/or by heat-curing adhesion) in a ram block or the three parts can be installed separately.

Figure 6A:
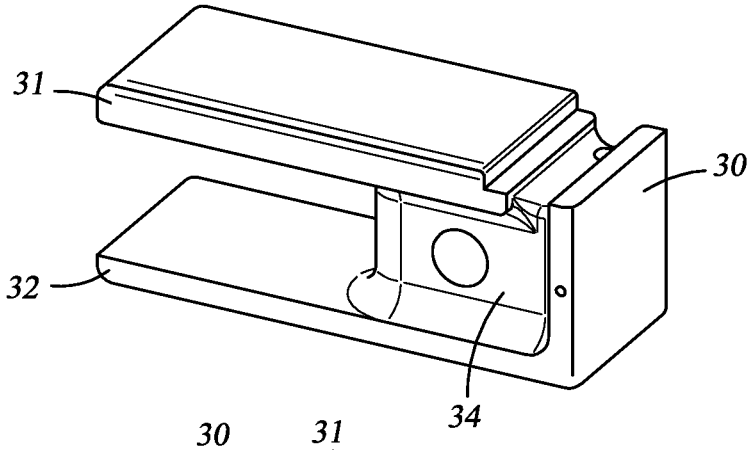
FIG. 6A is a perspective view of an extrusion plate structure for a blowout preventer according to the present invention.
Figure 6B:
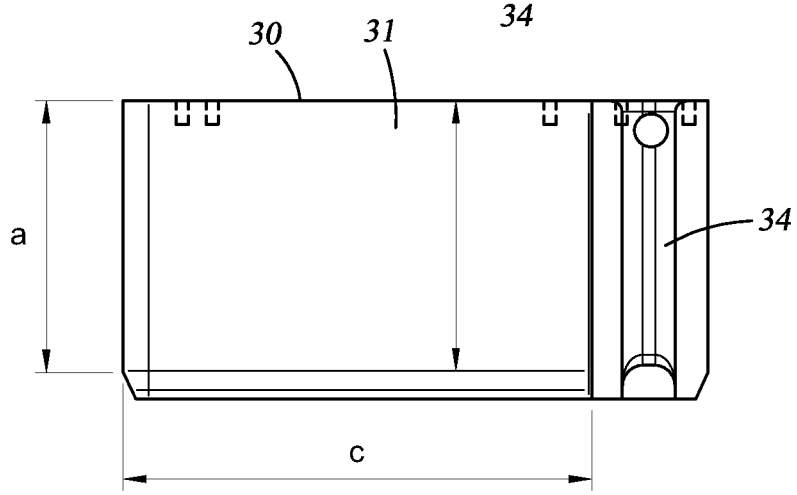
FIG. 6B is a top view of the structure of FIG. 6A.
Figure 7A:
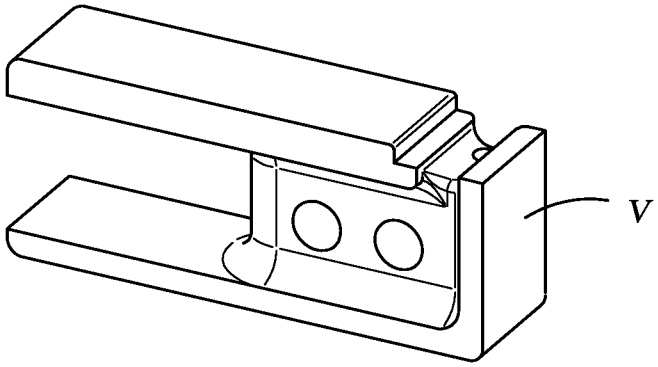
FIG. 7A is a perspective view of a prior art extrusion plate structure for a blowout preventer.
Figure 7B:
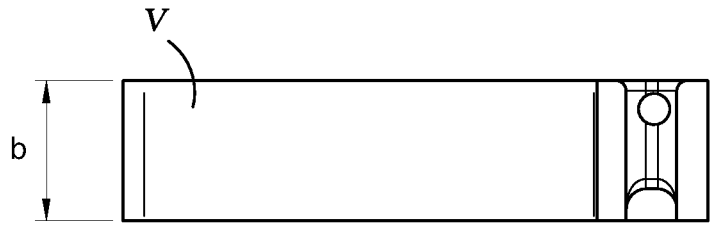
FIG. 7B is a top view of the structure of FIG. 7A.

FIGS. 6A and 6B show an extrusion plate structure 30 according to the present invention. The structure 30 has a significantly larger width "a" as compared to certain prior structures (e.g. one prior structure V with a width "b" as shown in FIGS. 7A, 7B). In one aspect such structures according to the present invention are at least 25% wider as viewed from above than are certain prior art structures. In one particular aspect such structures according to the present invention are about 50% wider (or more) as viewed from above as compared to certain prior art structures. In one aspect, a width "a" of a seal structure's top plate (i.e. a width of the seal projection) according to the present invention is at least about thirty five percent of a length "c" (see FIG. 6B) of a seal projection according to the present invention and in one particular aspect the width "a" is about sixty percent of the length "c".

The present invention, therefore, provides in some, but not in necessarily all embodiments a ram for a blowout preventer, the ram having: a ram body, the ram body having a front surface; seal structure on the ram body; the seal structure having two front faces including a first face and a second face; the seal structure having a projection projecting out therefrom; the first face on the projection; and the projection with the first face projecting out beyond a plane in which the second face is located. Such a ram may one or some, in any possible combination, of the following: a recessed portion formed by the seal structure for receiving part of a projection of an opposing ram, the recessed portion defined in part by the second face, and the second face positioned for sealing contact with a face of the projection of an opposing ram; a plurality of recesses for holding inserts for contacting a portion of a tubular adjacent the ram; the projection including a top plate connected to a base, and a bottom plate connected to the base; the top plate has a width and a length, the width at least thirty five percent of the length; wherein the width is about sixty percent of the length; a recess in the ram body, the recessed portion formed by the seal structure disposed in the recess of the ram body; the recess in the ram body is located for receiving the part of the projecting portion of an opposing ram and for supporting said part therein; and/or the recess is sized for sealing contact with said part of the projecting portion of an opposing ram.

The present invention, therefore, provides in some, but not in necessarily all embodiments a ram for a blowout preventer, the ram including: a ram body, the ram body having a front surface; seal structure on the ram body; the seal structure having two front faces including a first face and a second face; the seal structure having a projection projecting out therefrom; the first face on the projection; the projection with the first face projecting out beyond a plane in which the second face is located; a recessed portion formed by the seal structure for receiving part of a projection of an opposing ram; the recessed portion defined in part by the second face; the second face positioned for sealing contact with a face of the projection of an opposing ram; a recess in the ram body; the recessed portion formed by the seal structure disposed in the recess of the ram body; and the recess in the ram body located for receiving part of a projecting portion of an opposing ram and for supporting said part therein.

The present invention, therefore, provides in some, but not in necessarily all embodiments a seal structure for a ram of a blowout preventer, the seal structure having: a body having two front faces including a first face and a second face; a projection projecting out from the body; the first face on the projection; the second face in a plane; and the projection with the first face projecting out beyond the plane. Such a seal structure may one or some, in any possible combination, of the following: a recessed portion in the body for receiving part of a projection of an opposing ram, the recessed portion defined in part by the second face, and the second face positioned for sealing contact with a face of a projection of an opposing ram; a plurality of recesses for holding inserts for contacting a portion of a tubular adjacent the ram; a base, the projection including a top plate connected to the base, a bottom plate connected to the base, the top plate having a width and a length, and the width at least thirty five percent of the length; wherein the width is about sixty percent of the length; a recess in the body, the recessed portion formed by the seal structure disposed in the recess of the ram body; and/or the recess in the ram body is located for receiving part of a projecting portion of an opposing ram and for supporting said part therein, and the recess sized for sealing contact with said part of a projecting portion of an opposing ram.

The present invention, therefore, provides in some, but not in necessarily all embodiments a blowout preventer with two opposing rams, each ram having: a ram body, each ram body having a front surface, seal structure on each ram body, each seal structure having two front faces including a first face and a second face, the seal structure having a projection projecting out therefrom, the first face on the projection, and the projection with the first face projecting out beyond the plane in which the second face is located. In such a blowout preventer each ram may be any ram disclosed herein.

The present invention, therefore, provides in some, but not in necessarily all embodiments a method for sealing rams of a blowout preventer against a portion of a tubular located between the rams, the method including: moving opposing rams of a blowout preventer into contact with a portion of a tubular located between the rams, each ram being any ram disclosed herein according to the present invention; and moving each ram so a first face of each ram contacts a second face of an opposing ram.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with the requirements of 35 U.S.C. §112. The inventors may rely on the Doctrine of Equivalents to determine and assess the scope of their invention and of the claims that follow as they may pertain to apparatus and/or methods not materially departing from, but outside of, the literal scope of the invention as set forth in the following claims. All patents and applications identified herein are incorporated fully herein for all purposes. It is the express intention of the applicant not to invoke 35 U.S.C. §112, paragraph 6 for any limitations of any of the claims herein, except for those in which the claim expressly uses the words 'means for' together with an associated function. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

Whereas the present invention has been described in particular relation to the drawings attached hereto, it should be understood that other and further modifications apart from those shown or suggested herein, may be made within the scope and spirit of the present invention.

What is claimed is:

1. A ram for a blowout preventer, the ram comprising:

a ram body having a front surface and a plurality of recesses;

triangular inserts held by the plurality of recesses for contacting a portion of a tubular adjacent the ram; and a seal structure on the ram body about the triangular inserts, the seal structure having a first face and a second face, the seal structure having a projection at the first face extending beyond the triangular inserts and a recessed portion at the second face a distance behind a portion of the triangular inserts, the projection comprising a top plate connected to a base and a bottom plate connected to the base, the base on an exterior surface of the projection, the projection sealingly engageable with the recessed portion of the seal structure of an opposing ram.

2. The ram of claim 1, wherein the recessed portion is defined in part by the second face, the second face positioned for sealing contact with the first face of the projection of the opposing ram.

3. The ram of claim 2, further comprising a recess in the ram body, the recessed portion formed by the seal structure disposed in the recess of the ram body.

4. The ram of claim 3 wherein the recess in the ram body is located for receiving the part of the projection of the opposing ram and for supporting said part therein.

5. The ram of claim 4 wherein the recess is sized for sealing contact with said part of the projecting portion of the opposing ram.

6. The ram of claim 1 wherein the top plate has a width and a length, the width at least thirty five percent of the length.

7. The ram of claim 6 wherein the width is about sixty percent of the length.

8. A ram for a blowout preventer, the ram comprising:

a ram body having a front surface and a plurality of recesses;

triangular inserts held by the plurality of recesses for contacting a portion of a tubular adjacent the ram;

a seal structure on the ram body about the triangular inserts, the seal structure having a first face and a second face, the seal structure having a projection at the first face extending beyond the triangular inserts and a recessed portion at the second face a distance behind a portion of the triangular inserts, the projection comprising a top plate connected to a base and a bottom plate connected to the base, the base on an exterior surface of the projection, the projection sealingly engageable with the recess of the seal structure of an opposing ram, the recessed portion defined in part by the second face, the second face positioned for sealing contact with the first face of the projection of the opposing ram; and a recess in the ram body, the recessed portion formed by the seal structure disposed in the recess of the ram body, the recess in the ram body located for receiving part of the projection of the opposing ram and for supporting said part therein.

9. A seal structure for a ram of a blowout preventer, the seal structure comprising:

a body having a first face and a second face, and a plurality of recesses;

triangular inserts held by the plurality of recesses for contacting a portion of a tubular adjacent the ram; and a projection projecting out from the body about the inserts, the first face on the projection, the second face in a plane, the projection comprising a top plate connected to a base and a bottom plate connected to the base, the base on an exterior surface of the projection, the projection projecting out beyond the plane, the projection extending beyond the triangular inserts and a recessed portion at the second face a distance behind a portion of the triangular inserts, the projection sealingly engageable with the recessed portion of the seal structure of an opposing ram.

10. The seal structure of claim 9, wherein the recessed portion is defined in part by the second face, the second face positioned for sealing contact with the first face of the projection of the opposing ram.

11. The seal structure of claim 10 further comprising a recess in the body, the recessed portion formed by the seal structure disposed in the recess of the body.

12. The seal structure of claim 11 wherein the recess in the ram body is located for receiving part of the projecting portion of the opposing ram and for supporting said part therein, the recess sized for sealing contact with said part of the projecting portion of the opposing ram.

13. The seal structure of claim 9 wherein a width of the top plate is about sixty percent of a length of the top plate.

14. A blowout preventer with two opposing rams, each ram comprising:

a ram body having a front surface and a plurality of recesses;

triangular inserts held by the plurality of recesses for contacting a portion of a tubular adjacent the ram; and a seal structure on the ram body about the inserts, the seal structure having a first face and a second face, the seal structure having a projection at the first face extending beyond the triangular inserts and a recessed portion at the second face a distance behind a portion of the triangular inserts, the projection comprising a top plate connected to a base and a bottom plate connected to the base, the base on an exterior surface of the projection, the projection sealingly engageable with the recessed portion of the seal structure of an opposing ram.

15. The blowout preventer of claim 14, wherein the recessed portion is defined in part by the second face of the seal structure, the second face positioned for sealing contact with a face of the projection of the opposing ram, the blowout preventer further comprising:

a recess in the ram body, the recessed portion formed by a seal structure disposed in the recess of the ram body, the recess in the ram body located for receiving part of a projecting portion of an opposing ram and for supporting said part therein, the recess sized for sealing contact with the part of the projecting portion of the opposing ram.

16. A method for sealing rams of a blowout preventer against a portion of a tubular located between the rams, the method comprising:

moving opposing rams of the blowout preventer into contact with the portion of the tubular located between the rams, each ram comprising:

a ram body having a front surface and a plurality of recesses;

triangular inserts held by the plurality of recesses for contacting a portion of the tubular adjacent the ram; and a seal structure on the ram body about the triangular inserts, the seal structure having a first face and a second face, the seal structure having a projection at the first face extending beyond the triangular inserts and a recessed portion at the second face a distance behind a portion of the triangular inserts, the projection comprising a top plate connected to a base and a bottom plate connected to the base, the base on an exterior surface of the projection, the projection sealingly engageable with the recessed portion of the seal structure of an opposing ram; and moving the ram so the first face of the ram contacts the second face of the opposing ram.

* * * * *